United States Patent [19]

Weirich

[11] 4,159,673

[45] Jul. 3, 1979

[54] VENT BLOCK

[76] Inventor: James F. Weirich, 200 Posada Del Sol #40, Novato, Calif. 94947

[21] Appl. No.: 851,394

[22] Filed: Nov. 14, 1977

[51] Int. Cl.[2] ..... F24F 7/00

[52] U.S. Cl. ..... 98/37; 98/42 R; 98/DIG. 6; 52/199

[58] Field of Search ..... 98/DIG. 6, 32, 37, 42 R, 98/42 A, 2.11; 52/90, 92, 199, 303; 285/137 R

[56] References Cited

U.S. PATENT DOCUMENTS

| | | | |
|---|---|---|---|
| 27,872 | 4/1860 | Walcott | 98/DIG. 6 |
| 1,028,725 | 6/1912 | Hodgson | 98/42 A |
| 2,718,187 | 9/1955 | Frisby | 98/DIG. 6 |
| 3,018,713 | 1/1962 | Anderson | 98/DIG. 6 |
| 3,516,691 | 6/1970 | Williams et al. | 285/137R |
| 3,683,785 | 8/1972 | Grange | 98/37 |
| 3,863,553 | 2/1975 | Koontz | 98/42 |
| 3,874,710 | 4/1975 | Courtot | 285/137 R |
| 3,972,164 | 8/1976 | Grange | 98/DIG. 6 |

*Primary Examiner*—Henry C. Yuen
*Attorney, Agent, or Firm*—Thomas M. Freiburger

[57] ABSTRACT

A wooden vent block for use in construction to provide attic ventilation has patches of screen pressed into vent holes in the wooden member, in an interference fit. The elastically deformable screens are of an undeflected size slightly larger than the vent holes, so that they deform when pushed in and become springingly locked in place. At the opposite side of each hole is an air conduit tube press fit into that side of the hole, with the vent block angled in accordance with the roof line so that the air conduits angle upwardly into the attic. This puts the ends of the conduits above the attic floor insulation, so that the insulation never interferes with ventilation.

15 Claims, 5 Drawing Figures

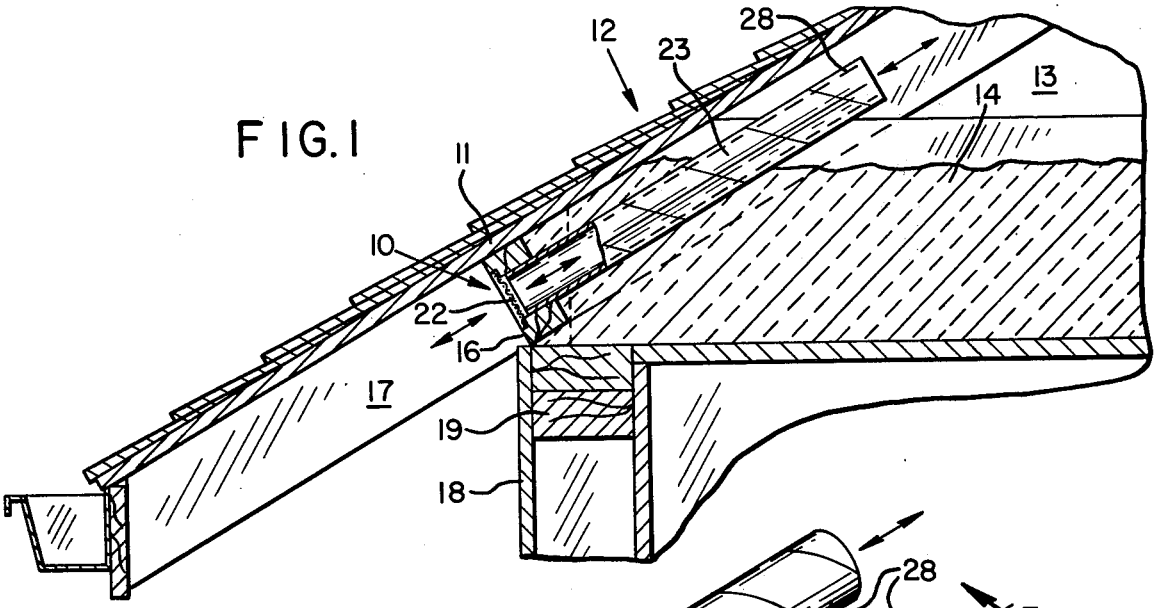
FIG. 1
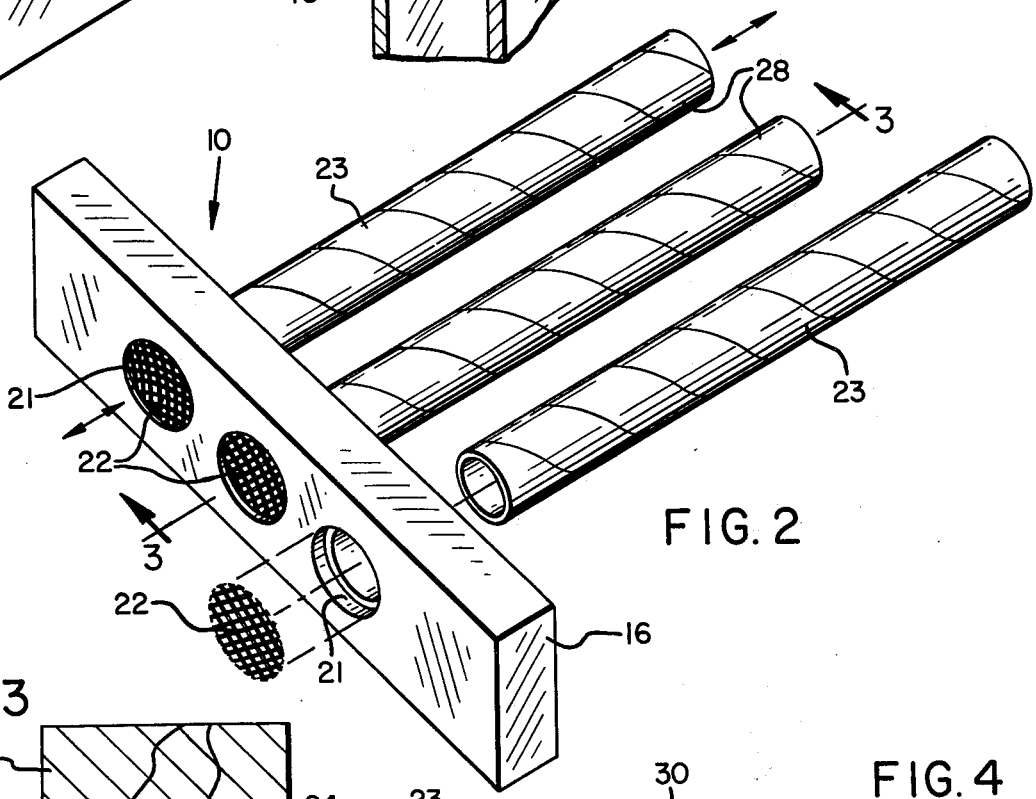
FIG. 2
FIG. 3
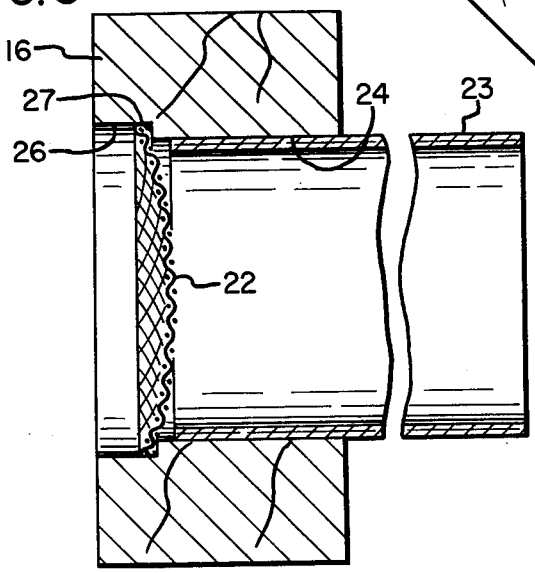
FIG. 4
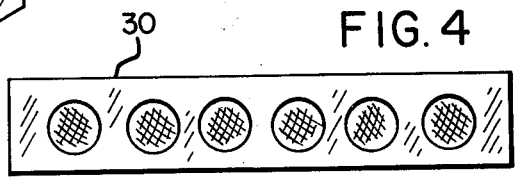
FIG. 5
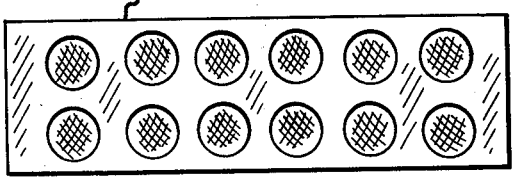

VENT BLOCK

BACKGROUND OF THE INVENTION

The invention relates to building attic ventilation, and more particularly to an improved wooden vent block for positioning between roof rafters at the edge of a pitched-roof attic, and a method of assembling and installing the vent block.

Nearly all building codes require a prescribed minimum area of ventilation openings, depending on the size of the attic space, at the edges of a pitched-roof attic below the eave. Ventilation is required to prevent rot and preserve the wooden structural members.

In the prior art, vent blocks, usually two-by-fours or two-by-sixes, depending on the roof rafter size, had holes with one long patch of insect screen nailed or stapled over the attic side of the holes. Attic insulation was a problem, because it could cover the vent holes. Usually a piece of plywood was angularly toe-nailed between the rafters to hold back the insulation in the area of the vent holes. This was difficult and time-consuming, as well as wasteful of materials. In addition, the attic floor space near the vent blocks was left uninsulated, due to the requirement that the insulation be held back.

Until the present invention described below, no attic vent block arrangement provided a practical, efficient way of solving the problem of providing for attic ventilation in building construction wherein there is to be attic floor insulation.

SUMMARY OF THE INVENTION

The present invention includes a precut, prebored vent block having a patch of screening pressed into each vent hole. This in itself is an improvement over prior vent blocks and methods of assembling them, since the screen patches, slightly larger than the vent holes into which they are pressed, are easily and quickly installed, without fasteners, and become firmly locked in place. The screen patch deflects and bows inwardly when forced into the opening, being of an at least partially elastically deformable material. The portion of the opening into which the screen is pressed may be a counterbore, larger in width or diameter than the remainder of the opening, so that a resulting ledge or ridge provides a stop defining the final position of the screen.

The vent blocks can be advantageously used in the form just described, in connection with prior art methods of installing vent blocks, or in installations not involving attic floor insulation, such as to vent the spaces associated with flat-roof rafters or even for venting foundation areas or crawl spaces. However, the vent blocks preferably include an air conduit extending from each vent opening in the direction toward the interior of the building, so that in a pitched-roof building having attic floor insulation, the ends of the tubes will extend above the insulation layer. This establishes the required ventilation without need for holding back the insulation in the vicinity of the vent holes. Being preferably of helically rolled paper, the air conduits are press fit into the vent holes usually after the wooden vent block member has been installed.

Preferably the screen patches and vent holes in which they are installed are circular, but other shapes could also be used, provided they can be economically produced. The screen patches are preferably pressed into the openings from the outside of the block, with the air conduit tube pressed into the attic side, although the two components could be installed from the same side, with the screen of course pressed in first.

The invention also encompasses a vent block having air conduits press fit into one side of the vent holes, as just described regardless of whether an insect screen is included. The screening may not be required in some circumstances, and the unscreened vent block is equally effective in solving the attic floor insulation problem. Screening may even be associated with the air conduit rather than with the wooden block member, if desired.

The invention further includes the described method of preparing, assembling and installing the vent block in its various forms.

Accordingly, it is among the objects of the invention to provide an improved vent block and method involving a novel and efficient means for connecting screening on the vent holes and a simple but effective and easily installed arrangement for preventing vent blockage by attic floor insulation. These and other objects, advantages and features of the invention will be apparent from the following description of a preferred embodiment, taken in conjunction with the appended drawings.

DESCRIPTION OF THE DRAWINGS

FIG. 1 is an elevational section view of a portion of a pitched-roof building attic floor insulation, showing a vent block according to the invention installed between roof rafters and providing ventilation to the attic space.

FIG. 2 is a partially exploded perspective view of the vent block alone.

FIG. 3 is an enlarged partially broken-away sectional view of the vent block as installed, similar to FIG. 1 and taken along the line 3—3 of FIG. 2.

FIG. 4 is a frontal view of a vent block according to the invention having a larger number of vent openings.

FIG. 5 is a view of another, deeper-section vent block, having still more vent openings.

DESCRIPTION OF THE PREFERRED EMBODIMENT

FIG. 1 shows a vent block 10 installed just below the pitched roof line 11 of a building 12 which has an attic 13 with attic floor insulation 14. The insulation may be of the laid fiberglass type or the blown-in type, but is, of course, very porous and very soft and pliable, so that with prior vent blocks as explained above, the insulation would tend to block or obstruct the vent block openings unless it was held away from the vicinity of the vent blocks by some device.

The vent block of the invention includes an elongate preferable wooden member 16, seen in section in FIG. 1. This member is positioned just below structural portions of the roof line 11, between adjacent roof rafters 17, with the depth of its section perpendicular to the roof line as shown. In general the depth of the member 16 should be the same as the rafters 17. It rests on the top of the wall 18 below, which may include a double horizontal plate 19 (a pair of two-by-fours, for example).

As shown in FIGS. 1, 2, and 3, the vent block 10 includes one or more vent openings 21 containing patches of screen 22, preferably at the exterior side of the openings, and air conduit tubes 23, one extending from the attic side of each vent opening. The attic side of each vent opening is sized the same as or just slightly smaller (perhaps on the order of a few thousandths)

than the end of the air conduit tube, so that the tube can be press fit into place and tightly retained in the wooden member 16.

The screens 22 are also sized (in original, undeformed state) larger than the portions of the vent openings into which they are positioned. However, the difference in size is much greater than in the case of the tubes, and may be, for example, about 1/16 inch. The size difference provides for an important feature of the invention: when pressed into place in the openings 21, the screen patches deform, bowing inwardly as best seen in FIG. 3. The screen is preferably of an at least partially elastically deformable material, such as a rust-protected steel or aluminum, so that it continues to exert an expansive springing force which holds it tightly in place.

As indicated in the drawings, the vent holes 21 may each comprise a main bore 24 and a counterbore 26 of a larger size at the exterior side of the member 16. This creates a ridge or ledge 27 which acts as a stop for the screen 22 when it is pushed into place. The screen is of course sized in accordance with this portion of the bore, whether or not a counterbore is provided and whatever the size of the counterbore.

As FIG. 1 indicates, the installed vent block 10 has its air conduit tubes 23 extending parallel to the roof line and thus angled upwardly into the attic. The length of the tubes is sufficient to bring the interior ends 28 above the top of the layer of attic floor insulation 14, which may be six or eight inches thick, for example. This avoids the problem of vent blockage without undesirable holding back of the insulation by cumbersome methods. In construction of a building, the elongate wooden member 16 preferably is installed after the screen patches 22 have been pressed into position, but before the air tubes 23 have been assembled into the member. The attic floor insulation 14 may be placed before or after the tubes 23 are installed. With most insulation, however, the tubes will nearly always be assembled into the members 16 before the insulation is laid.

The air tubes 23 may be formed from any suitable material, but helically rolled and glued heavy paper or cardboard is economical and has suitable strength and retention capability in the vent openings 21. The tubes may be treated with a fire retardant.

FIGS. 4 and 5 show vent blocks 30 and 31 having larger numbers of vent openings than the three illustrated in FIG. 2. There is no preferred number of openings, but the number and size of the openings is dictated by the ventilation requirements of the building's attic. A larger roof and attic may have deeper-section rafters, so that a vent block of the same depth may be provided, permitting more vent openings as in the vent block 31 of FIG. 5. The additional opening area may be needed for the larger attic space.

The above described preferred embodiment provides a vent block and method which are simple and economical in production and installation, yet which is more effective and dependable than prior venting systems. Various other embodiments and variations to this preferred embodiment will be apparent to those skilled in the art and may be made without departing from the spirit and scope of the following claims.

I claim:

1. A vent block for attic ventilation in a building, comprising:

an elongate wooden member adapted to fit beneath the roof line of the building, between adjacent rafters;

said wooden member having at least one circular bore therethrough, positioned to establish ventilating communication between the attic and the exterior of the building;

a circular patch of screen pressed into each such circular bore, the screen being of slightly larger original diameter than the portion of the bore into which it is pressed, so that it bows inwardly and is locked into the bore; and an air conduit tube extending axially from each bore, so that when the vent block is installed with the tube inclined upwardly into the attic, the tube is positioned to pass through attic floor insulation, thereby to prevent vent blockage by the insulation.

2. The vent block of claim 1 wherein said bore includes a second portion of smaller diameter than said portion into which the screen is pressed, providing an annular stop against which the screen is pressed, said air conduit tube being press fit into said second, smaller diameter portion.

3. The vent block of claim 1 wherein the air conduit tube extends from the side of the bore opposite the portion into which the screen is pressed.

4. The vent block of claim 1 wherein the air conduit tube is press fit into the bore, so that it can easily be installed on the job site after said elongate wooden member has been installed.

5. The vent block of claim 1 wherein the tube is of helically rolled paper material.

6. An attic ventilation installation in a building having an inclined roof with a series of parallel roof rafters over an attic having floor insulation, comprising:

between each pair of adjacent rafters, an elongate wooden member extending perpendicularly to the rafters, each member having one surface oriented parallel to the roof line and at least one bore through the member with the bore axis parallel to the roof line; and a cylindrical air tube extending from the attic side of the bore, parallel to the roof line, through the attic floor insulation to a point above the insulation;

whereby the attic is properly ventilated without vent blockage by the insulation.

7. The attic ventilation installation of claim 6 wherein the air tube is press fit into the bore.

8. The attic ventilation installation of claim 6 which further includes a circular patch of screen pressed into each circular bore, the screen being of slightly larger original diameter than the portion of the bore into which it is pressed, so that it deflects inwardly and is springingly engaged in the bore.

9. The attic ventilation installation of claim 8 wherein the portion of the bore into which the screen is pressed is of larger diameter than the remainder of the bore, providing an annular ledge against which the screen is pressed.

10. The attic ventilation installation of claim 8 wherein the portion of the bore into which the screen is pressed is at the exterior side of the wooden member.

11. A vent block for installation in a building to provide attic ventilation, comprising:

an elongate member adapted to fit beneath the roof line of the building, between adjacent rafters, with the length of the member parallel to the wall below and perpendicular to the rafters such that the member divides the attic space from the exterior of the building;

said member having at least one circular bore therethrough, positioned to provide ventilating communication between the attic and the exterior of the building; and a cylindrical air tube extending axially from one end of each bore;

whereby the vent block may be installed between the rafters of the building with the tube inclined upwardly into the attic, thereby to reach above attic insulation and prevent vent blockage by the insulation.

12. The vent block of claim 11 wherein the air tube is of helically rolled paper material.

13. The vent block of claim 12 wherein the air tube is press fit into the bore.

14. The vent block of claim 11 which further includes screen means for preventing the passage of insects through each bore and air tube.

15. The vent block of claim 14 wherein said screen means comprises a circular patch of an elastically deformable screen material pressed into each circular bore, the screen being of slightly larger undeformed diameter than the portion of the bore into which it is pressed, so that it bows elastically inwardly and is springingly engaged in the bore.

* * * * *